United States Patent [19]

Kobryn

[11] 3,987,882

[45] Oct. 26, 1976

[54] PRINTER WITH HORIZONTALLY MOVABLE PRINT HEAD

[75] Inventor: Ronald J. Kobryn, Westwood, N.J.

[73] Assignee: Computer Transceiver Systems, Inc., Paramus, N.J.

[22] Filed: Apr. 3, 1975

[21] Appl. No.: 564,752

[52] U.S. Cl. ..... 197/1 R; 308/3 R

[51] Int. Cl.[2] ..... B41J 3/04

[58] Field of Search ..... 197/1 R, 18, 49, 55; 101/93.15, 93.16; 346/76 R; 308/3 R, 3 A

[56] References Cited

UNITED STATES PATENTS

| | | | |
|---|---|---|---|
| 1,558,236 | 10/1925 | Burton | 308/3 A |
| 3,128,073 | 4/1964 | Berlyn | 308/3 R |
| 3,144,919 | 8/1964 | Foote et al. | 308/3 R X |
| 3,509,980 | 5/1970 | Loughry et al. | 197/1 R |
| 3,805,552 | 4/1974 | Heald | 308/3 R X |
| 3,897,982 | 8/1975 | Teramachi | 308/3 A X |

*Primary Examiner*—Ralph T. Rader

*Attorney, Agent, or Firm*—Hane, Sullivan & Spiecens

[57] ABSTRACT

A printer has a horizontal platen for supporting paper and a print head which moves horizontally opposite thereto during indexing operations and is driven toward the platen for character printing. The print head is mounted on a carriage bearing block acting as a linear bearing and having a passageway of complex cross-section resulting from the superimposition of a square and a circle. A controllably rotatable carriage shaft passes through the passageway of the block.

4 Claims, 10 Drawing Figures

FIG. 5
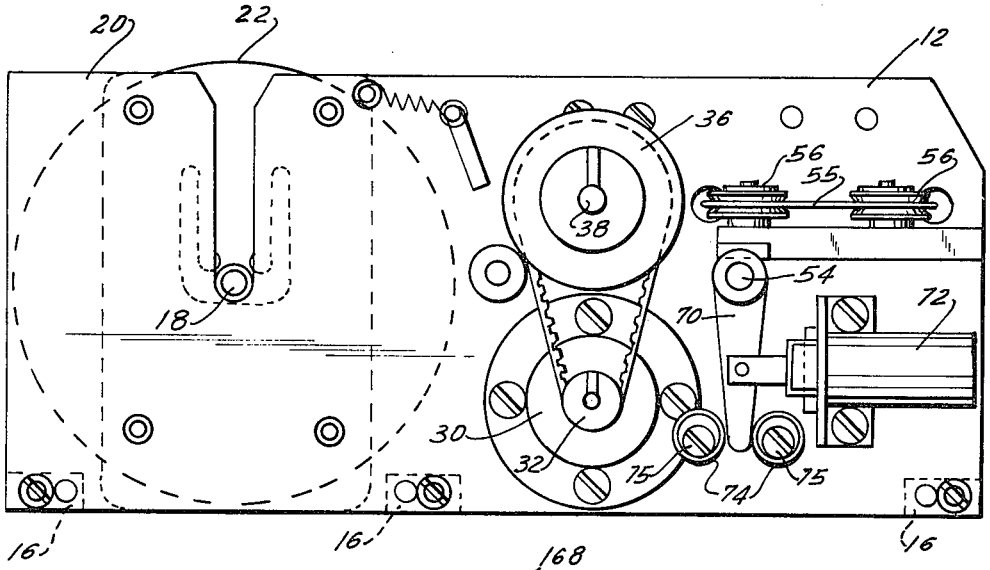
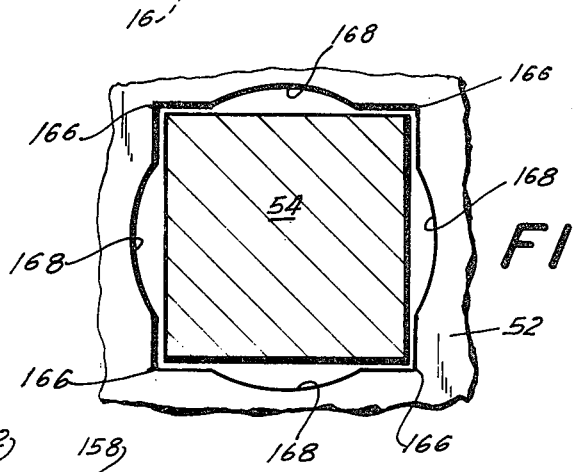
FIG. 10
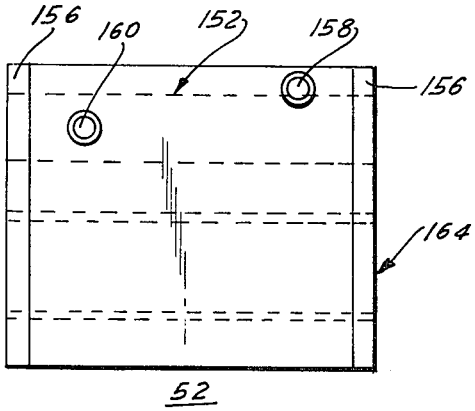
FIG. 8
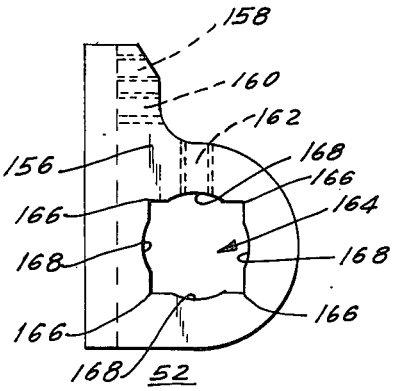
FIG. 9

PRINTER WITH HORIZONTALLY MOVABLE PRINT HEAD

This invention pertains to printers such as are used in data terminals.

Generally such printers need not procure hard copy having a quality as good conventional mechanical impact printers such as typewriters. Instead the printer should operate at relatively high speeds for extended periods of time and should have a long mean time between failures. In addition, for portable and mass market terminals, the printers should be as simple and light weight as possible.

In order to satisfy most of these requirements there has been developed a thermal print head which forms characters from an array of selectively heated elements in a dot matrix. The head is used with a thermally sensitive paper.

Such thermal print heads have become very popular and have created a demand for even simpler and inexpensive carriage mechanisms for carrying the heads opposite the platens. Heretofore, a head was mounted on a carriage which traveled along rails by means of a complicated bearing system. Such a system is very expensive to fabricate and is sufficiently complex to affect its reliability and servicability.

It is accordingly a general object of the invention to provide a printer with an improved carriage mechanism. It is a further object of the invention to provide an improved printer with a carriage mechanism which is extremely simple, low in inertia and relatively immune to dust and the like.

Briefly, the invention contemplates a printer having a horizontal platen for supporting paper and a print head which moves horizontally opposite the platen and which is reciprocatingly driven toward the platen when printing a character. The print head is fixed in a channel of a carriage bearing block which has a through passageway with a complex cross section. The carriage bearing block is spindled on a shaft of polygonal cross-section, the shaft extending parallel to the direction of the platen. A means is provided for reciprocatingly rotating the shaft when a character is to be printed.

Other objects, the features and advantages of the invention will be apparent from the following detailed description when read with the accompanying drawing which shows the presently preferred embodiment of the invention. In the drawing:

FIG. 5 is a left end elevation as viewed from line 5—5 of FIG. 3;

FIG. 8 is a front elevation detailed of a carriage bearing block;

FIG. 9 is a side elevation detail of the carriage bearing block of FIG. 8;

FIG. 10 is a fragmentary sectional view of the carriage bearing block on a carriage shaft in accordance with the invention.

Figure 1:
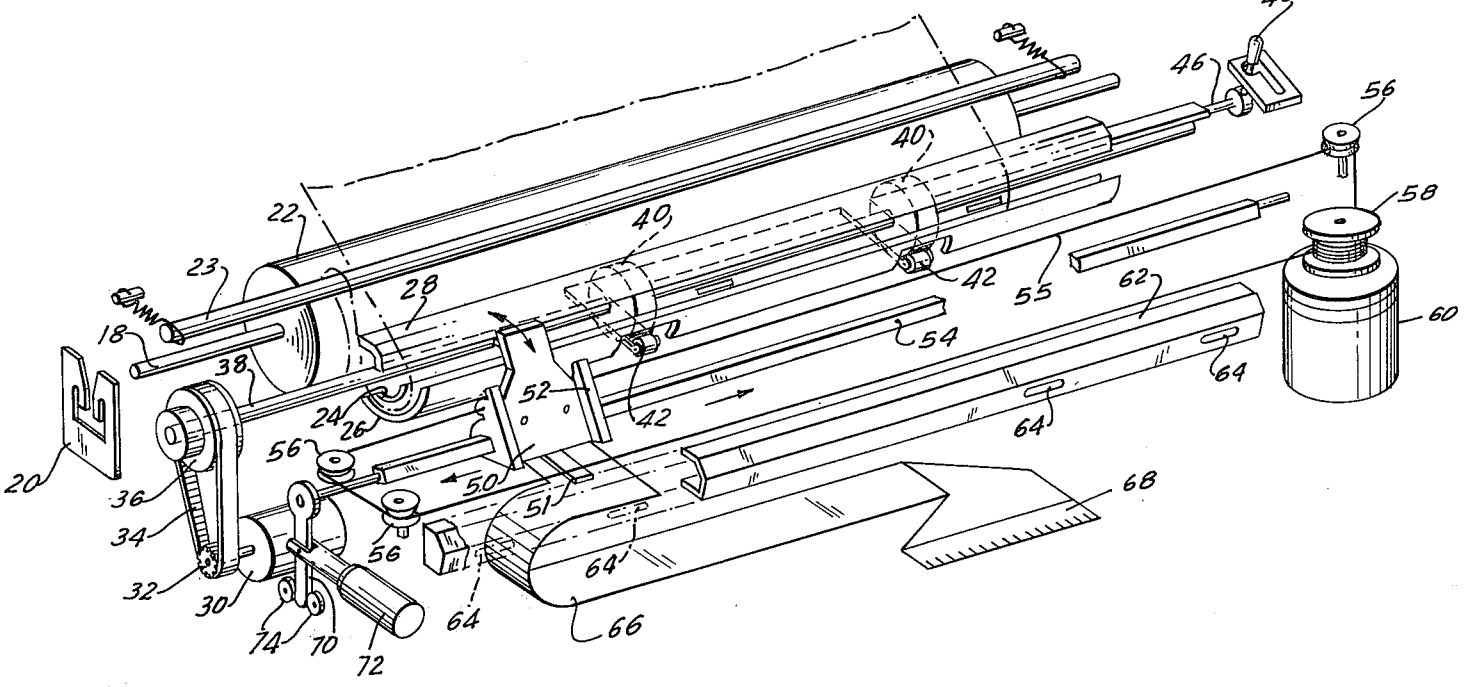
FIG. 1 is a schematic prespective of a printer in accordance with the invention with its main frame removed.
Figure 2:
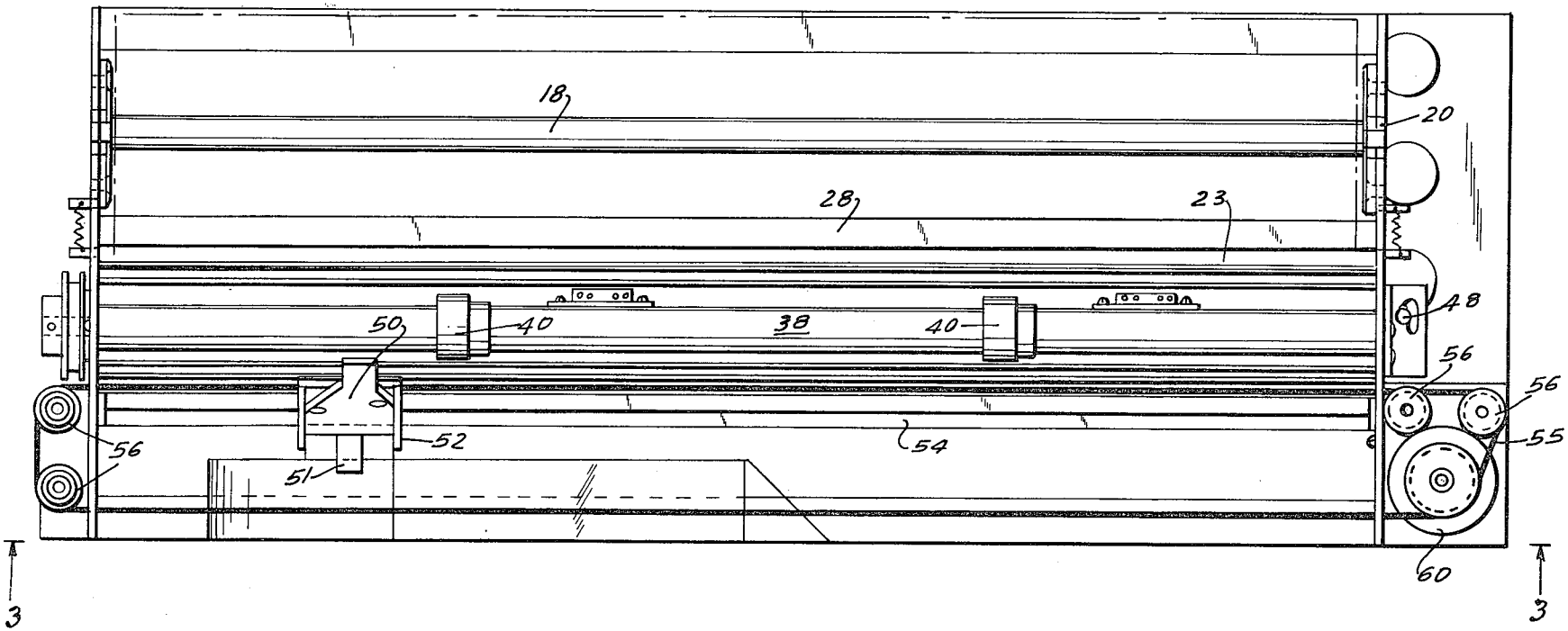
FIG. 2 is a top plan view of the printer with a lamp and sensor housing removed.
Figure 3:
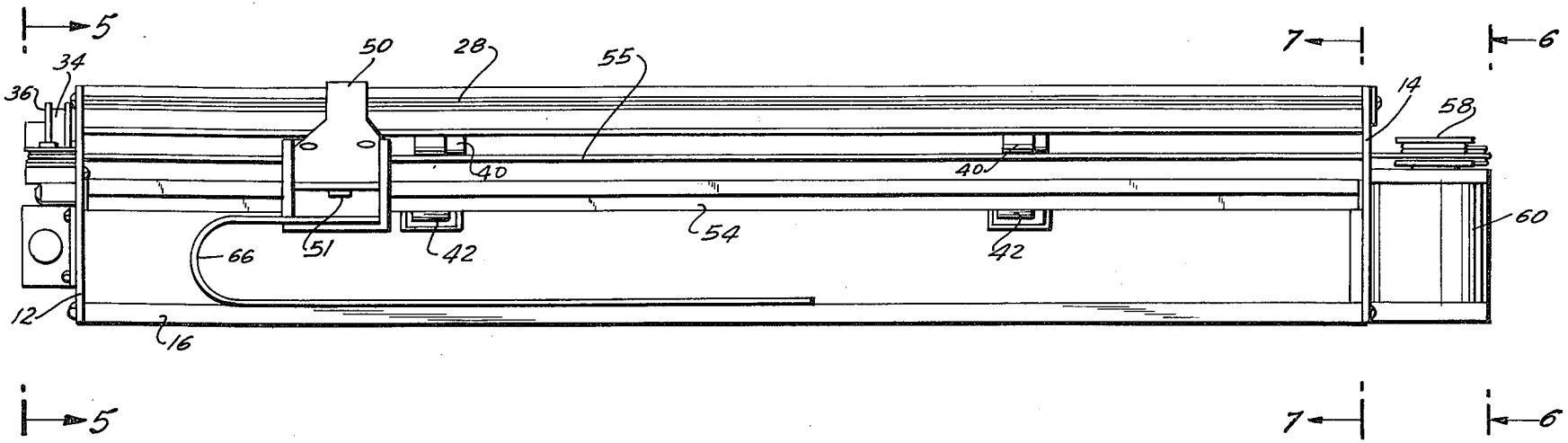
FIG. 3 is a front elevation along the lines 3—3 of FIG. 2.
Figure 4:
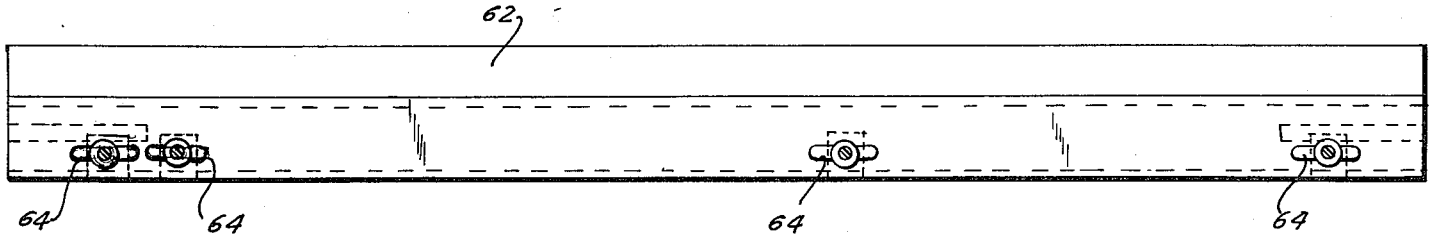
FIG. 4 is a front elevation of a sensor housing.
Figure 6:
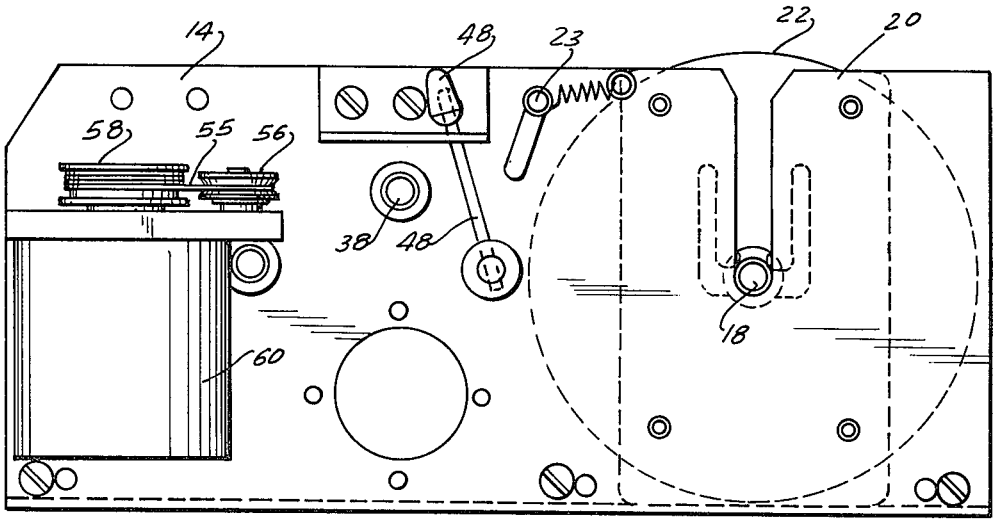
FIG. 6 is a right end elevation as viewed from line 6—6 of FIG. 3.
Figure 7:
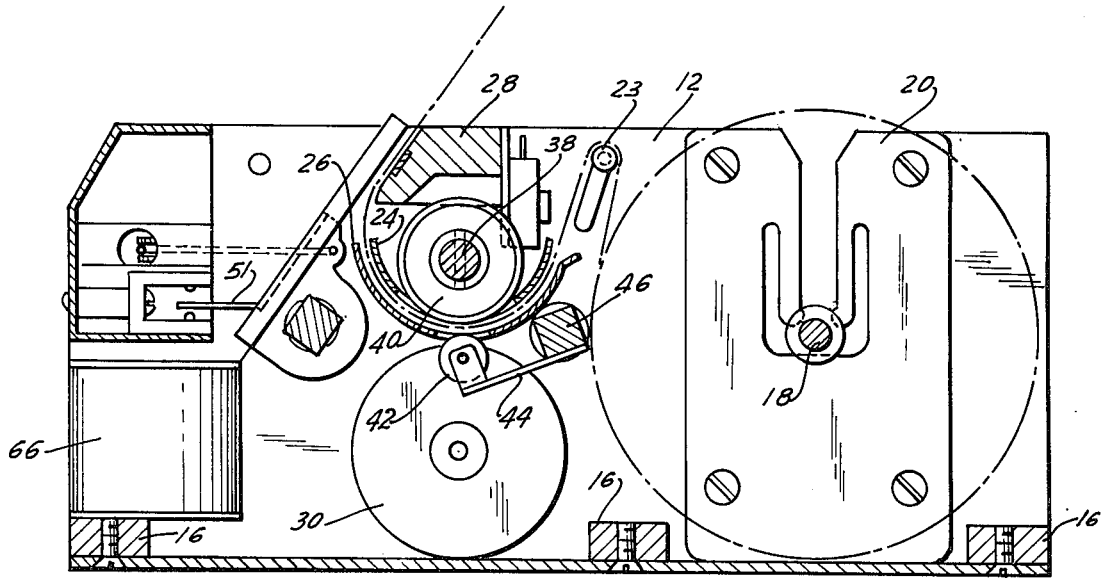
FIG. 7 is a transverse vertical section taken along line 7—7 of FIG. 3.

The printer shown schematically in FIG. 1 and in more detail in FIGS. 2 to 7 is supported by a frame comprising left end wall 12 and right end wall 14 fixed to horizontal base rods 16 (see FIGS. 3, 5, 6 and 7). The printer includes a paper supply shaft 18 carried by slotted paper supply supports 20 fixed to the end walls 12 and 14 upon which is spindled a roll of paper 22. The paper passes over a spring loaded dancer roller 23 through a paper guide comprising a rear chute 24 and a front chute 26, and over platen 28.

Paper is fed by means of paper feed motor 30 having a paper feed drive pulley 32 which drives driver pulley 36 via bet 34. Pulley 36 in turn rotates feed shaft 38 to which are connected paper feed rollers 40. Feed rollers 40 extend through slots in rear paper chute 24 to cooperate with paper tension rollers 42 which pass through slots in front paper chute 26. See FIG. 7. Tension rollers 42 are mounted on leaf springs 44 connected to shaft 46 which can be rotated by means of lever 48 to provide a gap between rollers 40 and 42 when paper is initially loaded through the chutes.

Moving horizontally opposite platen 28 is a thermal printing head 50 mounted on carriage bearing block 52 which is spindled on carriage shaft 54 of square cross-section. Connected to bearing block 52 is a cable 55 which is guided by idlers 56 to drive pulley 58 on the shaft of pulley drive motor 60. The rotation of motor 60 causes the horizontal movement of head 50. Extending from carriage bearing block 52 is an interrupter tab 51 for interrupting light beams in sensors 64 horizontally positioned along housing 62. The head 50 is of the thermal type which is energized by signals fed to it via flat cable 66 connected to terminal block 68.

In order to print a character, selective portions of the head are energized (heated) by signals in the leads of cable 66, then the head 50 is pressed against the paper 22. The pressing is accomplished by rotating carriage shaft 54 which is connected via lever 70 to solenoid 72. The travel of the lever is controlled by stops 74. Stops 74 are eccentrically mounted on end plate 12 by means of screws 75 so that rotation of the stops changes the permissible travel of lever 70.

Attention is now called to FIGS. 8, 9 and 10 which show the carriage bearing block in detail. In particular, the face of the block is provided with a channel 152 having shoulders 156 for positively accepting the head 50. The head is rigidly mounted therein by means of screws (not shown which are accepted by threaded holes 158 and 160. In addition a screw hole 162 is provided for accepting a screw and bracket arrangement to which cable 55 (See FIG. 1) is fixed. Oriented horizontally through block 52 there is machined a novel passageway 164 for accepting carriage shaft 54. The passageway has a complex cross section with verticles 166 conforming to the corners of a square and intermediate regions 168 conforming to arcs of a circle. Thus, since shaft 54 has a square cross-section it is seen that shaft 54 positively engages verticals 166 when the shaft is rotated about its major axis. In addition, the smooth horizontal movement of the carriage block 52 over shaft 54 is obtained because of the gaps between the edges 168 and the sides of shaft. This unusually large clearance minimizes the chance of bearing-to-shaft binding due to the accumulation of paper dust and the like since the configuration is self cleaning. In addition precise smooth and free horizontal movement is obtained because the vertex contacting arrangement minimizes the friction between the bearing and the shaft. Finally, the simplicity of the bearing block 52 and particularly when made from aluminum, provides a very low mass head structure with little inertia. Therefore, for given size motors and solenoids fast printing rates are achieved, or one can use less powerful motors and solenoids for a specified printing rate.

Although shaft 52 preferrably has a square cross-section other polygonal cross-sections can be used. Thus, for different cross-sections of shaft 52, the vertices 166 of the cross-section of passageway 164 would have corresponding contours. Furthermore, although the intermediate regions 168 conform to arcs of a circle other set back contours could be used such as two legs of a triangle or three sides of a square.

There has been shown an improved printer utilizing a novel carriage bearing block for supporting a printing head in combination with a rotatable carriage shaft which has less friction and inertia that heretofore known combinations.

While only one embodiment of the invention has been shown and described in detail there will now be obvious to those skilled in the art many modifications and variations satisfying many or all of the objects of the invention but which do not depart from the spirit thereof as defined by the appended claims.

What is claimed is:

1. In a printer having a horizontal platen for supporting paper and having a print head which moves horizontally opposite the platen and is reciprocatingly driven toward said platen when printing a character, the improvement comprising: a shaft extending along a line parallel the platen and having a length substantially equal to the length of the platen, said shaft having a cross-section in the form of a first regular polygon with vertices; means for controllably rotating said shaft; and a bearing block spindled on said shaft, said bearing block having a through passageway with a cross-section which is delimited by the concentric superposition of a circle and another regular polygon similar to said first regular polygon, the radius of said circle being shorter than the distance from the center to the vertex of said other regular polygon so that a gap exists between the portions of said shaft intermediate said vertices and the opposing wall of the passageway, said bearing block having a channel for accepting the head.

2. The printer of claim 1 wherein said polygon is a square.

3. The printer of claim 1 wherein said means for controllably rotating said shaft is a lever arm connected to said shaft and a solenoid connected to said lever arm.

4. The printer of claim 3 further comprising stop means for limiting the travel of said lever arm.

* * * * *